United States Patent [19]

Tassie

[11] 4,244,270

[45] Jan. 13, 1981

[54] FEEDER FOR A GUN

[75] Inventor: Douglas P. Tassie, St. George, Vt.

[73] Assignee: General Electric Company, Burlington, Vt.

[21] Appl. No.: 921,657

[22] Filed: Jul. 3, 1978

[51] Int. Cl.[3] ..... F41D 10/02

[52] U.S. Cl. ..... 89/33 C; 89/33 CA; 74/57; 74/107

[58] Field of Search ..... 74/57, 107; 89/33 R, 89/33 MC, 33 B, 33 BA, 33 BB, 33 BC, 33 C, 33 CA

[56] References Cited

U.S. PATENT DOCUMENTS

| | | | |
|---|---|---|---|
| 999,890 | 8/1911 | Shedd | 74/57 |
| 1,335,839 | 4/1924 | Johnston | 89/33 BA |
| 1,351,753 | 9/1920 | Hover | 74/57 |
| 1,749,137 | 3/1930 | Hudson | 89/33 B |
| 1,945,616 | 2/1934 | Mastrud | 74/57 |
| 2,113,202 | 4/1938 | Stange | 89/33 CA |
| 3,915,058 | 10/1975 | Folsom et al. | 89/33 CA |
| 4,015,511 | 4/1977 | Folsom et al. | 89/33 CA |

FOREIGN PATENT DOCUMENTS 1231594 12/1966 Fed. Rep. of Germany ..... 89/33 BA

OTHER PUBLICATIONS

Robert E. Brix, "The Chain Gun for the AAH-Design-to-Cost in Action, " NATIONAL DEFENSE, Jan.-Feb. 1974, pp. 352-354.

J. Philip Geddes, "Introducing the Chain Gun," INTERNATIONAL DEFENSE REVIEW, Apr. 1977, vol. 10, No. 2, pp. 271-274.

*Primary Examiner*—Stephen C. Bentley

*Attorney, Agent, or Firm*—Bailin L. Kuch

[57] ABSTRACT

This invention provides for a feeder tray which is journaled for rotation on a longitudinal axis and which includes two longitudinally extending cutouts, one for receiving fresh rounds of ammunition in sequence from a constant velocity train of ammunition and for transferring each round to the face of the gun bolt in aft dwell, the other for receiving the fired case and for displacing the fired case from the face of the gun bolt, and driven by a cylindrical cam system.

9 Claims, 7 Drawing Figures

TIME CYCLE DIAGRAM OF MAIN CAM

FEEDER FOR A GUN

BACKGROUND OF THE INVENTION

1. Field of the Invention

This invention relates to a mechanism for transporting a round of ammunition from an in-feed sprocket mechanism to the face of a gun bolt.

2. Prior Art

It is now known to provide an in-feed sprocket mechanism which pulls a train of rounds at a constant velocity and which hands off successive rounds to an intermediate mechanism which, in turn, transports each round in sequence at a nonuniform velocity to the face of the bolt of the gun, and concurrently displaces the fired case from the face of the bolt. Such a system is shown in U.S. Pat. No. 3,915,058 filed by L. R. Folsom et al on Oct. 3, 1973, and U.S. Pat. No. 4,015,511 filed by L. R. Folsom et al on Aug. 19, 1974. Such a system appears to be discussed by R. E. Brix in "National Defense" of January–February 1974, pp 351–354, and by J. P. Geddes in "International Defense Review" of April 1977, pp. 271–274. In the Folsom et al mechanisms, the intermediate mechanisms are driven in a single direction by eliptical gears. In the Brix and Geddes mechanisms, the intermediate mechanisms apparently are driven in a single direction by a geneva movement.

SUMMARY OF THE INVENTION

It is an object of this invention to provide an improved feeder of the type which places the round of ammunition directly onto the face of the gun bolt.

It is an additional object to provide such a feeder for use with a single barrel gun. Such a gun may be a conventional gun firing fully cased ammunition, or a liquid propellant gun having a case, e.g. a stub case.

It is another object to provide such a feeder wherein the intermediate mechanism is driven by a drum cam to optimize the displacement of the round as a function of time.

It is yet another object to provide such a feeder wherein the intermediate mechanism is integral with a driven drum cam to minimize deflection and to maximize the accuracy of the displacement thereof.

It is still another object to provide an improved feeder and bolt assembly.

A feature of this invention is the provision of a feeder tray which is journaled for rotation on a longitudinal axis and which includes two longitudinally extending cutouts, one for receiving fresh rounds of ammunition in sequence from a constant velocity train of ammunition and for transferring each round to the face of the gun bolt in aft dwell, the other for receiving the fired case and for displacing the fired case from the face of the gun bolt, and driven by a cylindrical cam system.

BRIEF DESCRIPTION OF THE DRAWINGS

These and other objects, features and advantages of the invention will be apparent from the following specification thereof taken in conjunction with the accompanying drawing in which.

DESCRIPTION OF THE INVENTION

Figure 1:
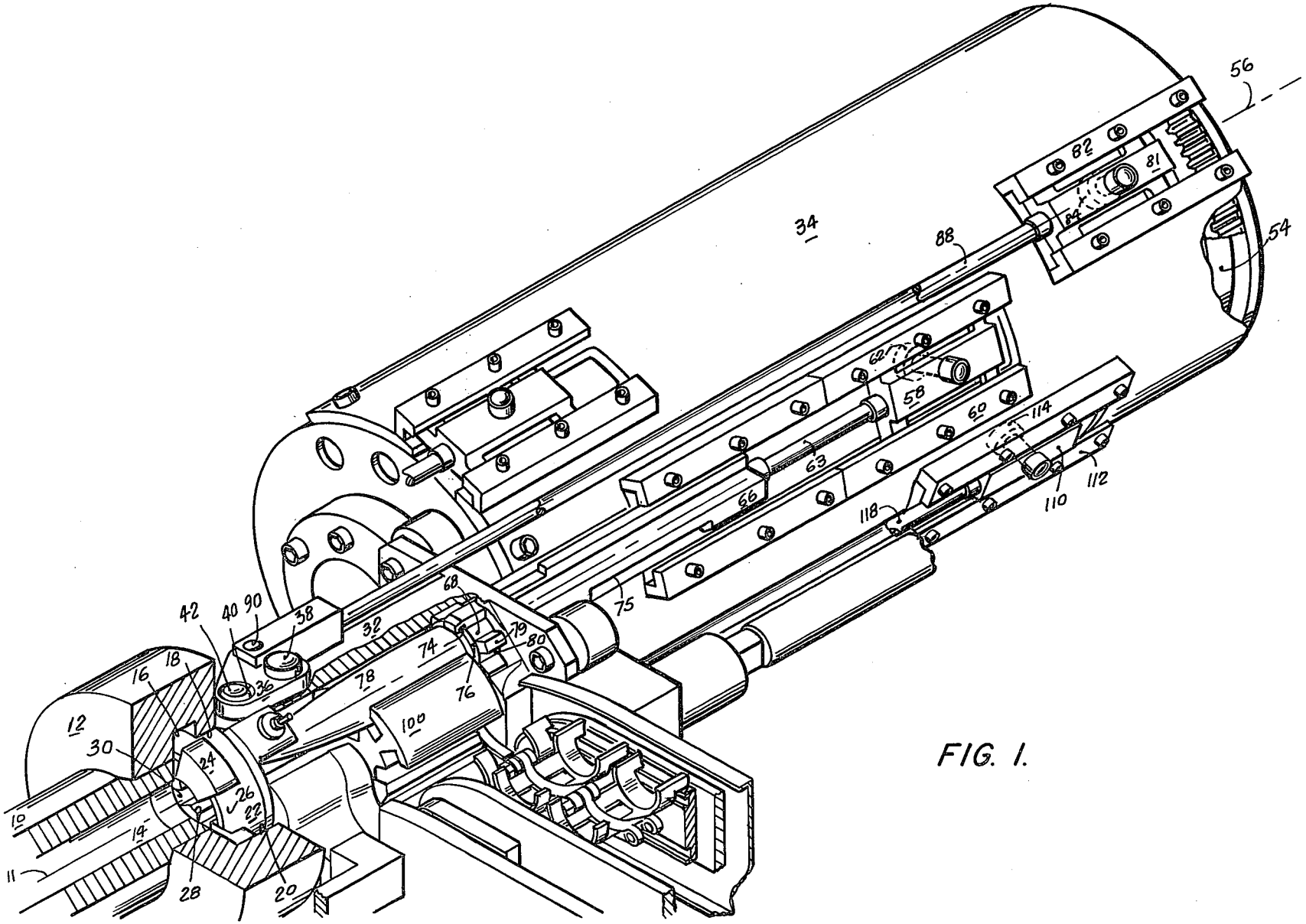
FIG. 1 is a perspective view, partly broken away, of a portion of a single barrel gun embodying the invention.
Figure 2:
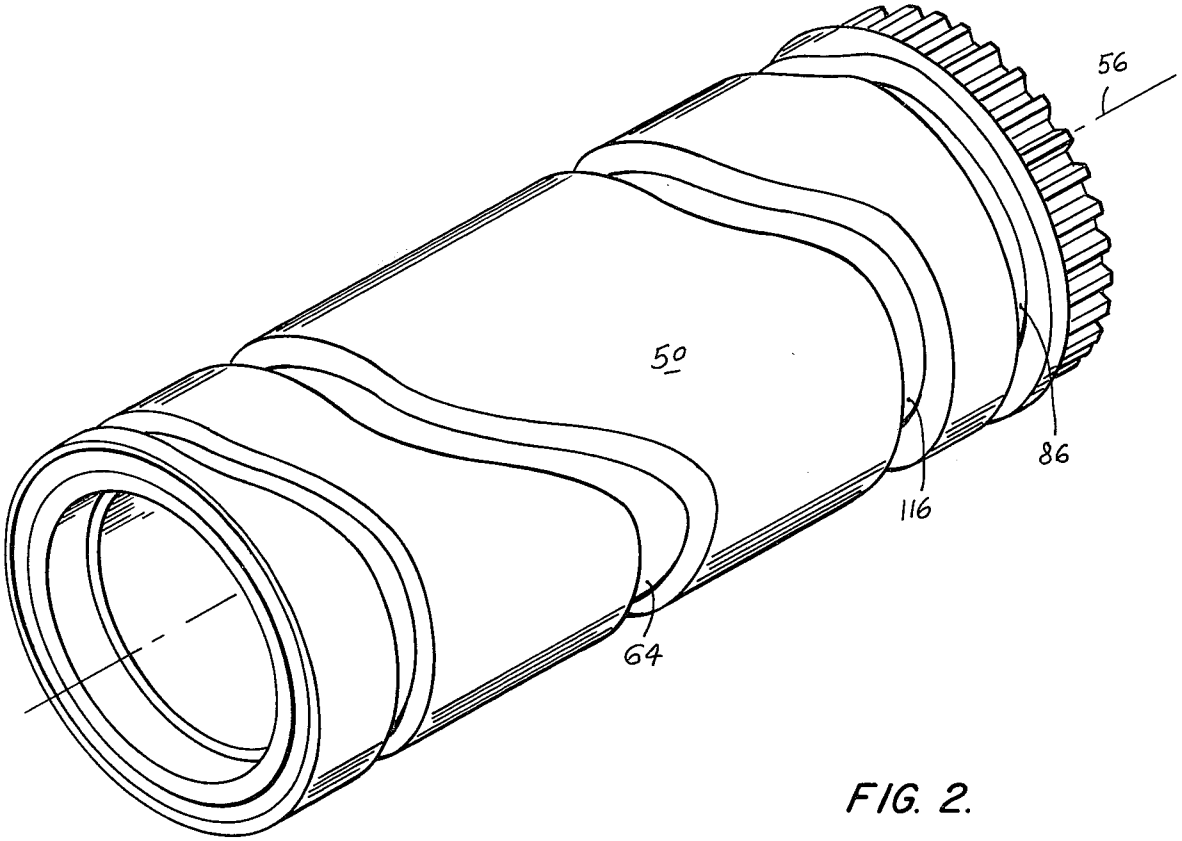
FIG. 2 is a perspective view, of the control cam of the gun of FIG. 1.
Figure 4:
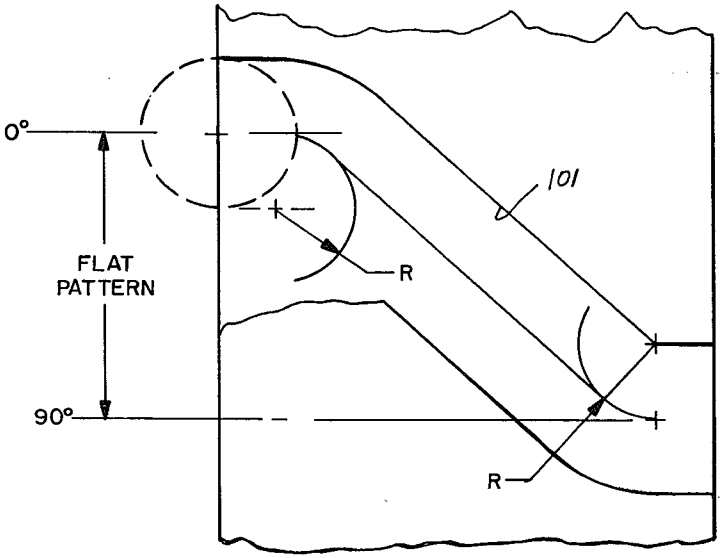
FIG. 4 is a flat pattern of the cam track of the feed tray of FIG. 3.

The single barrel gun embodying this invention includes a gun barrel 10 having a longitudinal axis 11 fixed to a barrel extension 12. The gun barrel has a chamber 14 for receiving a round of ammunition. The barrel extension includes an annular recess 16 which is transversely faced with a plurality of lugs 18 radially spaced apart by lacunae 20. A ring 22 for locking the gun bolt head to the barrel extension is disposed within the annular recess 16 and has a plurality of outwardly directed lugs 24 radially spaced apart by lacnae 26, and a plurality of inwardly directed lugs 28 radially spaced apart by lacunae 30. The lugs 24 will longitudinally clear the lacunae 20 when aligned therewith. When misaligned, the lugs 18 capture the ring 22 within the recess 16. A feeder cover 32 is fixed to the housing 34 of the gun, to which is also fixed the barrel extension 12. A lever 36 is pivoted by a pin 38 to the feeder cover 32 and coupled by a socket 40 and a ball head pin 42 to the ring 22. Oscillation of the lever 36 about the pin 38 causes oscillation of the ring 22 about the longitudinal axis 11 of the gun barrel.

A drum cam 50 with outwardly opening cam tracks is journaled for rotation on fore (hidden) and aft bearings 54 about a longitudinal axis 56 which is parallel to the longitudinal axis 11. A plurality of pairs of guide tracks for cam followers fixed to the housing 34 parallel to the cam longitudinal axis 56.

A cam follower slide 58 is journaled for reciprocation in a pair of guide rails 60. The slide 58 carries a cam follower roller 62 which rides in a cam track 64 in the drum cam 50. The slide 58 is fixed to a push rod 63 which is fixed to the aft end of the gun bolt 66. The gun bolt has a head portion 68 with a pair of spaced apart extractor hooks 70 and 72 projecting forwardly from the bolt face to define a diametrical channel 74 adapted to receive the extractor disk 76 of the case 78 of a round of ammunition. The bolt head also has six outwardly directed lugs 79 radially spaced apart by lacunae 80. The body of the gun bolt has a recess 75 to clear a feed tray when the bolt is in its forward, locked position.

A cam follower slide 81 is journaled for reciprocation in a pair of guide rails 82. The slide 81 carries a cam follower roller 84 which rides in a cam track 86 in the drum cam. The slide is fixed to a push rod 88 which is pivoted by a pin 90 to the lever 36.

A rotary feed tray or sprocket 100 is journaled for oscillation on a shaft 102, with a bushing 104, and fore (hidden) and aft thrust washers 108. The shaft 102 is fixed to the housing on the axis 52. The tray has a helical cam track 101. A cam follower slide 106 is journaled for reciprocation in a pair of guide rails 109 and carries a cam follower roller 107 which rides in the tray cam track 101. A cam follower slide 110 is journaled for reciprocation in a pair of guide rails 112 and carries a cam follower roller 114 which rides in a cam track 116 in the drum cam. A push rod 118 has its aft end fixed to the slide 110 and its forward end fixed to the slide 106. Rotation of the drum cam 50 thus reciprocates the slide 110, which in turn reciprocates the slide 106, which in turn oscillates the tray 100.

The tray, (looking forwardly) has a left hand channel or cut-out 120 and a right hand channel or cut-out 122, mutually radially spaced apart, here shown by 90°. Each of the channels is adapted to pass the gun bolt head with a round or case, and has three lacunae 124 to respectively pass three of the bolt head lugs 79. The dwell positions of the tray are aligned with the dwell portions of the cam track 101.

Rounds of ammunition are provided to the gun at a uniform velocity by an endless conveyor system of the type shown by R. G. Kirkpatrick in U.S. Pat. No. 3,429,221, issued Feb. 25, 1969. An endless belt of conveyor elements 130, each carrying a respective round of ammunition, passes a turn-around sprocket 132. As each element passes the turn-around sprocket, a set of guides including an extractor disk guide 134 deflects the respective round out of the conveyor and into the left hand channel of the tray. Another set of guides serves as an ejection channel 136 to pass fired cases which have been slid from the face of the gun bolt by the right hand channel.

The relative positions of the gun bolt, the rotary feed tray and the bolt head locking ring are controlled by the drum cam by means of the respective cam followers and push rods. The synchronization of the endless conveyor system with the drum cam may be accomplished by a suitable solenoid operated clutch such as the knife blade clutch shown by L. K. Wetzel in U.S. Pat. No. 3,578,118, issued May 11, 1971.

The gun is operated by two controls, not shown. One provides power on-off to a motor which drives the drum cam in rotation. The other provides power on-off to the solenoid of the clutch.

Figure 3:
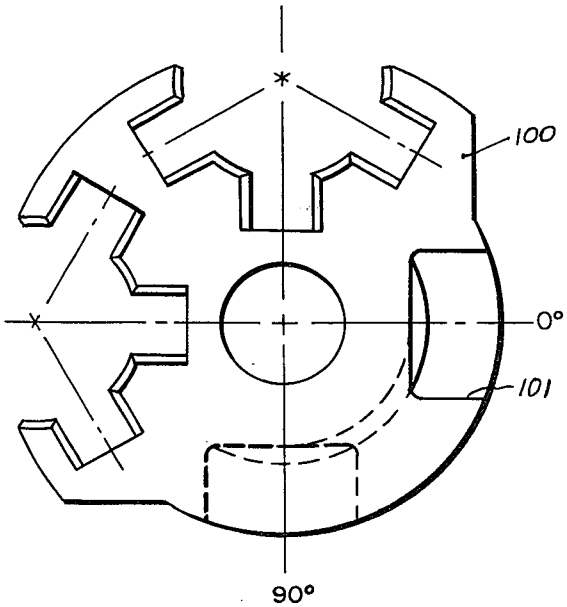
FIG. 3 is an end view of the feed tray of the gun of FIG. 1.
Figure 5:
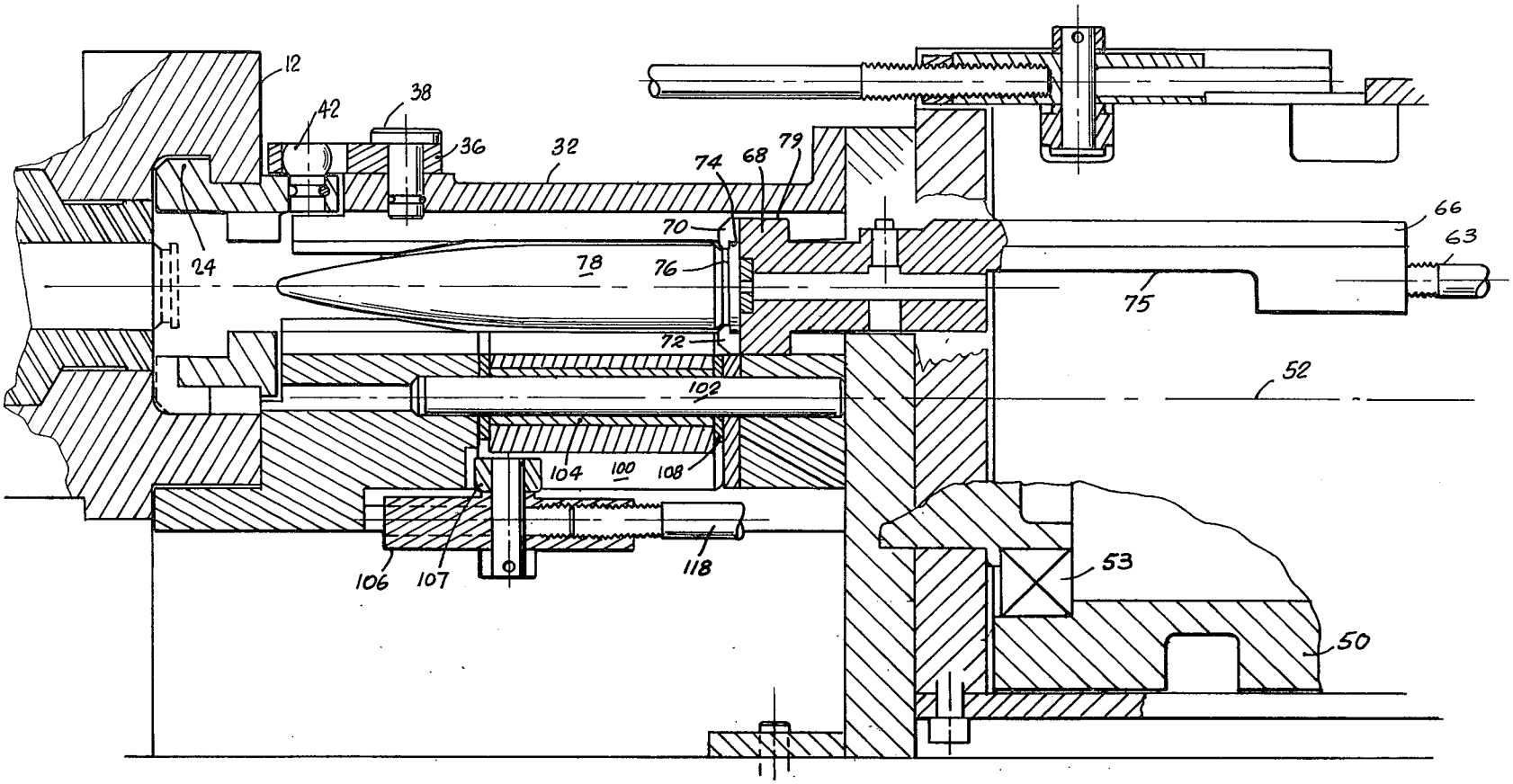
FIG. 5 is a side view in longitudinal cross-section of a part of the gun of FIG. 1.
Figure 6:
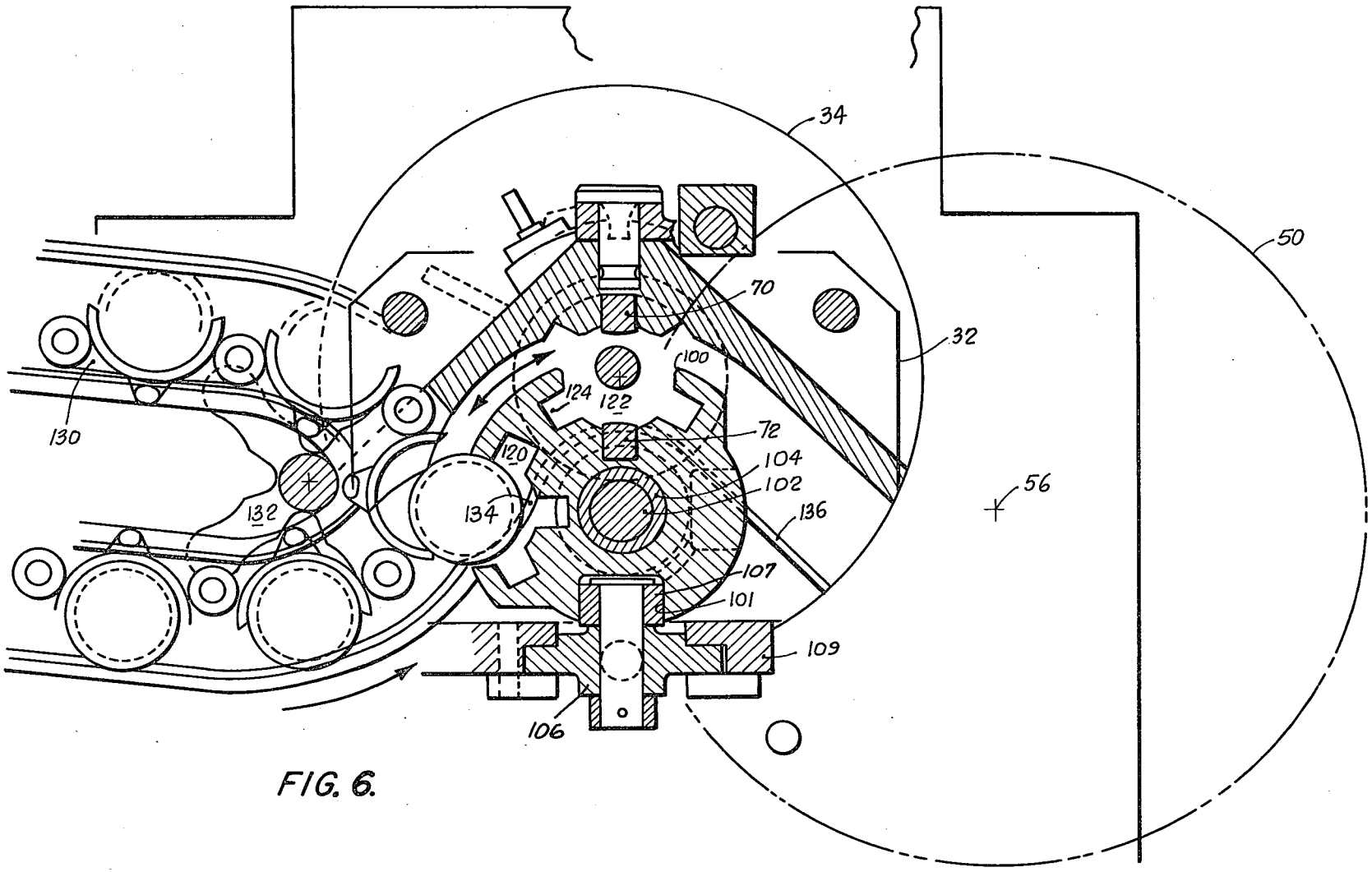
FIG. 6 is an end view in transverse cross-section in part of the gun of FIG. 1.
Figure 7:
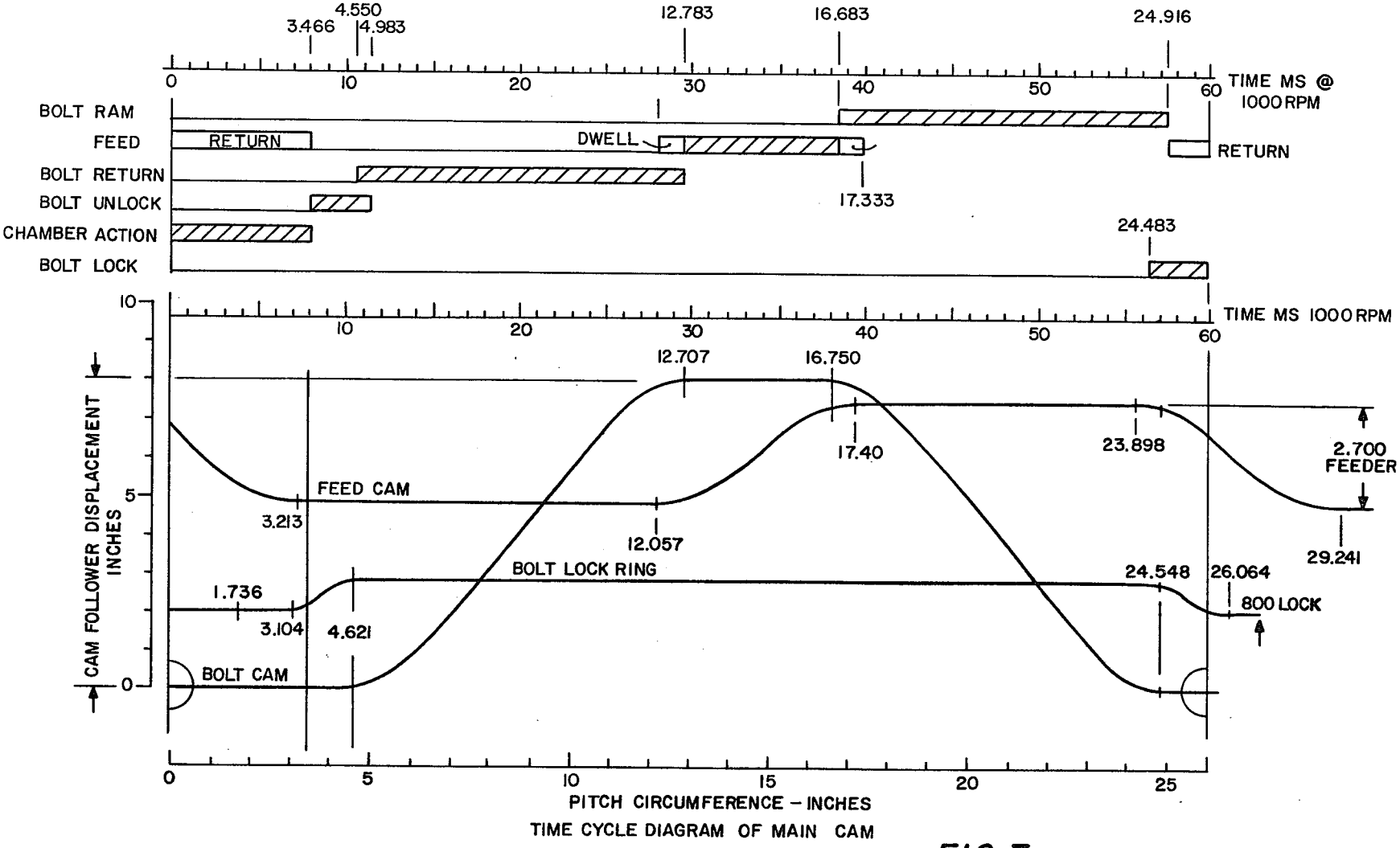
FIG. 7 is a chart of the time cycle of operation of the gun of FIG. 1.

The gun operating cycle commences with the gun bolt open and in its aft position, aligned with the feed tray, as shown in FIG. 1. The feed tray is in its counterclockwise position, with the left hand channel adjacent the conveyor turn-around sprocket, as shown in FIG. 3.

When power is applied the motor starts the rotation of the drum cam and the clutch solenoid enables the clutch, which engages at its first opportunity to synchronize the conveyor with the drum cam and starts the advancement of the conveyor to hand off the initial round of ammunition to the left hand channel of the feed tray.

The gun bolt is open and in its aft most position, aligned with the feed tray.

The feed tray rotates clockwise, sliding the round of ammunition in the left hand channel onto the face of the gun bolt with the extractor disk of the case engaged in the extractor groove of the extractor lugs of the gun bolt.

The gun bolt moves forward and rams the round into the chamber of the gun barrel. The lugs of the bolt head pass through the lacunae of the bolt head locking ring.

The locking lever is swung clockwise to swing the bolt head locking ring clockwise to engage the locking ring lugs behind the bolt head lugs to lock the bolt head to the barrel extension.

The round of ammunition is fired.

The locking lever is swung counterclockwise to swing the bolt head locking ring counterclockwise to disengage the locking ring lugs from behind the bolt head lugs to unlock the bolt head.

Contemporaneously with the locking, firing and unlocking of the bolt, the feed tray rotates counterclockwise to bring the left hand channel adjacent to hand-off sprocket.

The conveyor hands off the second round of ammunition into the left hand channel of the feed tray.

The unlocked bolt moves aft carrying the case of the fired initial round through the right hand channel of the feed tray.

The feed tray rotates clockwise, sliding the fired case of the initial round from the face of the gun bolt into the ejection channel.

This process repeats until power is removed from the clutch solenoid, which disables the clutch at the first opportunity to stop the conveyor with the next round in sequence withheld from the feed tray.

The feed tray rotates clockwise, with no round in the left hand channel, and slides the last fired case from the face of the gun bolt into the ejection channel.

The gun bolt moves forward to close.

The locking lever is swung to lock and then unlock the gun bolt, while the feed rotates counterclockwise to bring the left hand channel adjacent to the hand-off sprocket.

The use of a feed tray with an integral cam track driven by a cam follower provides many advantages over the prior art:

1. The angular position of the feed tray is not subject to shaft deflections or drive variations.
2. The versatility of a cam permits optimum feed tray rotation characteristics.
3. Precision alignment with the bolt is achieved with fewer critical tolerances.
4. The system can be scaled to any size.
5. The system has lower weight and cost.

I claim:

1. An ammunition feeder for a gun having a longitudinally reciprocating gun bolt, including:

first means driven at a substantially uniform angular velocity, for advancing a train of rounds of ammunition at a substantially uniform linear velocity;

second means driven at a non-uniform angular velocity, for receiving a round of ammunition from said first means and for transversely translating such round directly onto the face of the gun bolt of the gun, and for transversely translating such round from the face of the gun bolt of the gun;

driving means for said second means including a first cylindrical cam having a first peripheral cam track;

a second cylindrical cam, coupled to and driving said second means, having a second peripheral cam track;

a first cam follower disposed in said first cam track;

a second cam follower disposed in said second cam track; and link means intercoupling said first and second cam followers, whereby rotation of said first cam causes rotation of said second means;

said gun bolt being journaled for reciprocation along a first longitudinal axis;

said second means being journaled for movement about a second longitudinal axis; and said driving means serves to oscillate said second means about said second longitudinal axis.

2. A feeder according to claim 1 wherein: said first and second axes are parallel.

3. An ammunition feeder for a gun having a longitudinally reciprocating gun bolt, including:

first means driven at a substantially uniform angular velocity, for advancing a train of rounds of ammunition at a substantially uniform linear velocity;

second means driven at a non-uniform angular velocity, for receiving a round of ammunition from said first means and for transversely translating such round directly onto the face of the gun bolt of the gun, and for transversely translating such round from the face of the gun bolt of the gun;

driving means for said second means including a first cylindrical cam having a first peripheral cam track;

a second cylindrical cam, coupled to and driving said second means, having a second peripheral cam track;

a first cam follower disposed in said first cam track;

a second cam follower disposed in said second cam track; and link means intercoupling said first and second cam followers, whereby angular movement of said first cam causes angular movement of said second means.

4. A feeder according to claim 3 wherein:

said second cylindrical cam is journaled for angular movement about a third longitudinal axis;

said second and third axes being parallel.

5. A feeder according to claim 3 wherein:

said second means and said second cylindrical cam are integral.

6. A feeder according to claim 3 wherein:

said second means has a first station whereat it receives a fresh round from said first means and a previously fired case from said bolt; and a second station whereat it completes delivery of such fresh round to said bolt and ejects such previously fired case.

7. A feeder according to claim 6 wherein:

said second cam track has a first dwell portion aligned with said first station of said second means, and a second dwell portion aligned with said second station of said second means.

8. A feeder according to claim 7 wherein:

said second means has a first and a second longitudinally extending passageway, mutually radially spaced apart, each passageway adapted and arranged to pass a round of ammunition and to pass the head of said bolt.

9. A feeder according to claim 8 wherein:

the gun further includes a fired case ejection port; and in said first station of said second means, said first longitudinally extending passageway is adjacent said first means for receiving a first round of ammunition therefrom, and said second longitudinally extending passageway is aligned with said head of said bolt for passing said head therethrough; and in said second station of said second means, said first longitudinally extending passageway is aligned with said head of said bolt and said second longitudinally extending passageway is adjacent such ejection port.

* * * * *